US006056422A

United States Patent [19]

Huang

[11] Patent Number: 6,056,422

[45] Date of Patent: May 2, 2000

[54] CHRISTMAS LIGHT WITH AN ELASTIC ATTACHMENT

[76] Inventor: Shun-Feng Huang, No.56, Min Sheng Street, Feng-Yuan City 420, Taiwan

[21] Appl. No.: 09/255,357

[22] Filed: Feb. 23, 1999

[51] Int. Cl.[7] ..... F21V 21/00

[52] U.S. Cl. ..... 362/391; 362/396

[58] Field of Search ..... 362/249, 238, 362/391, 396, 810

[56] References Cited

U.S. PATENT DOCUMENTS 5,228,774 7/1993 Liao ..... 362/391

5,738,435 4/1998 Lin et al. ..... 362/249

*Primary Examiner*—Stephen Husar

[57] ABSTRACT

A Christmas light with a elastic attachment is provided. The attachment is integrated with a circular cap in the bottom of an electrical socket having an elastic plate of roughly U-shaped section which includes a lower end integrated with a center of the cap, an arcuate receiving space defined in the bottom of the U-shape, an upwardly projected upper end and a narrow entrance positioned under the upper end and abutting the receiving space. So that a linear object can enter into the arcuate receiving space and is lightly gripped by the attachment when it enters into the receiving space.

1 Claim, 4 Drawing Sheets

CHRISTMAS LIGHT WITH AN ELASTIC ATTACHMENT

BACKGROUND OF THE INVENTION

The present invention relates to Christmas lights, and more particularly to a Christmas light including an elastic attachment which can be elastically and releasably attached to the electric wires, string of a network or any object to be attachable.

Typical Christmas lights are strung spacedly in a pair of electric wires to obtain greater cosmetic effect people use the strings of the Christmas light to form a pattern, a signal or a word. To this end, each of the Christmas light mush have something attachable a linear object. So that a varied attaching means such as a hook, a clip, a lug etc., integrate with the light. FIG. 1 shows an attachable Christmas light which includes generally a socket 10, a cap 11 engaged with the bottom of the socket 10 to secured a pair of electric wire 14 and a bulb 12 engaged into the socket 10. The cap 11 has a first hook 111 and a second hook 112 both of which are attachable to a linear object. However, the first hook 111 is not reliable and it only simply hangs the Christmas light on a thing.

SUMMARY OF THE PRESENT INVENTION

The present invention has a main object to provide a Christmas light with an elastic attachment which can be readily and releasably attached to a linear object such as the electric wire of its own string, a string of a network, etc.

Another object of the present invention in to provide a Christmas light with an elastic attachment which attachment is reliable without breakaway and enables to keep the bulbs of the light toward a predetermined direction.

The present invention will become more fully apparent by reference to the detailed description thereof when read in accompanying with the attached drawings.

DETAILED DESCRIPTION OF THE PREFERRED EMBODIMENT

Figure 1:
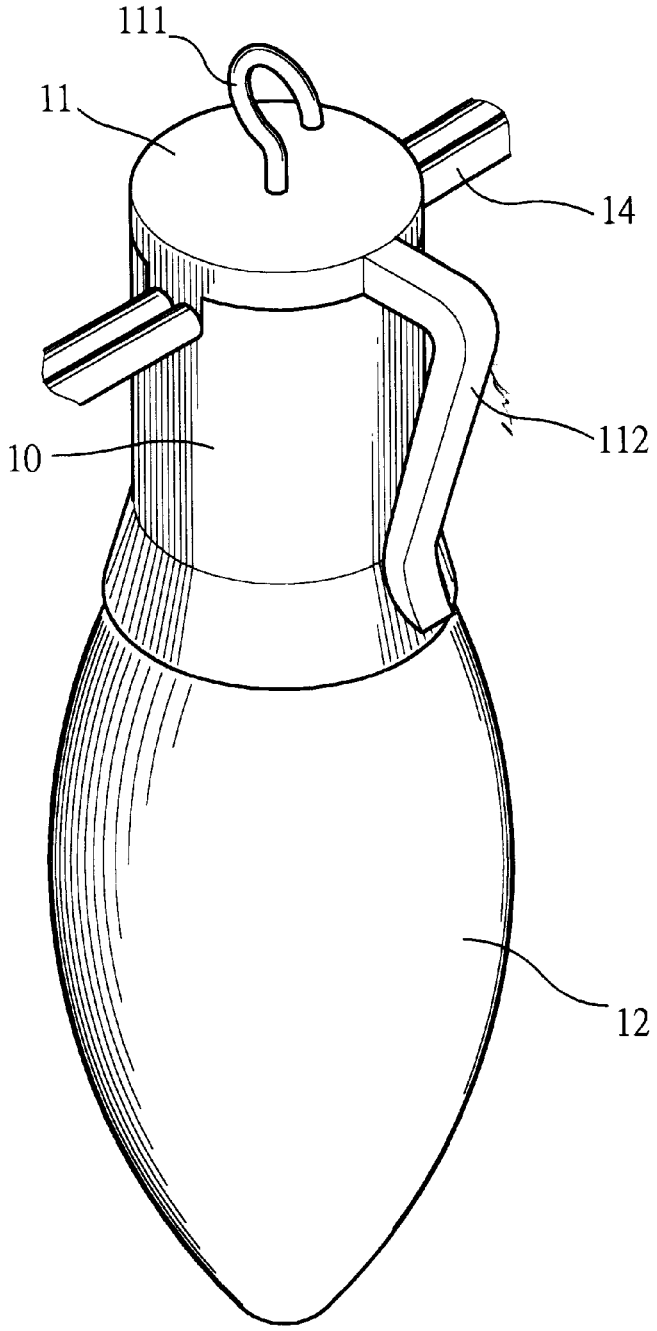
FIG. 1 Prior Art
FIG. 1 is an perspective view of a Christmas light according to a prior art.
Figure 2:
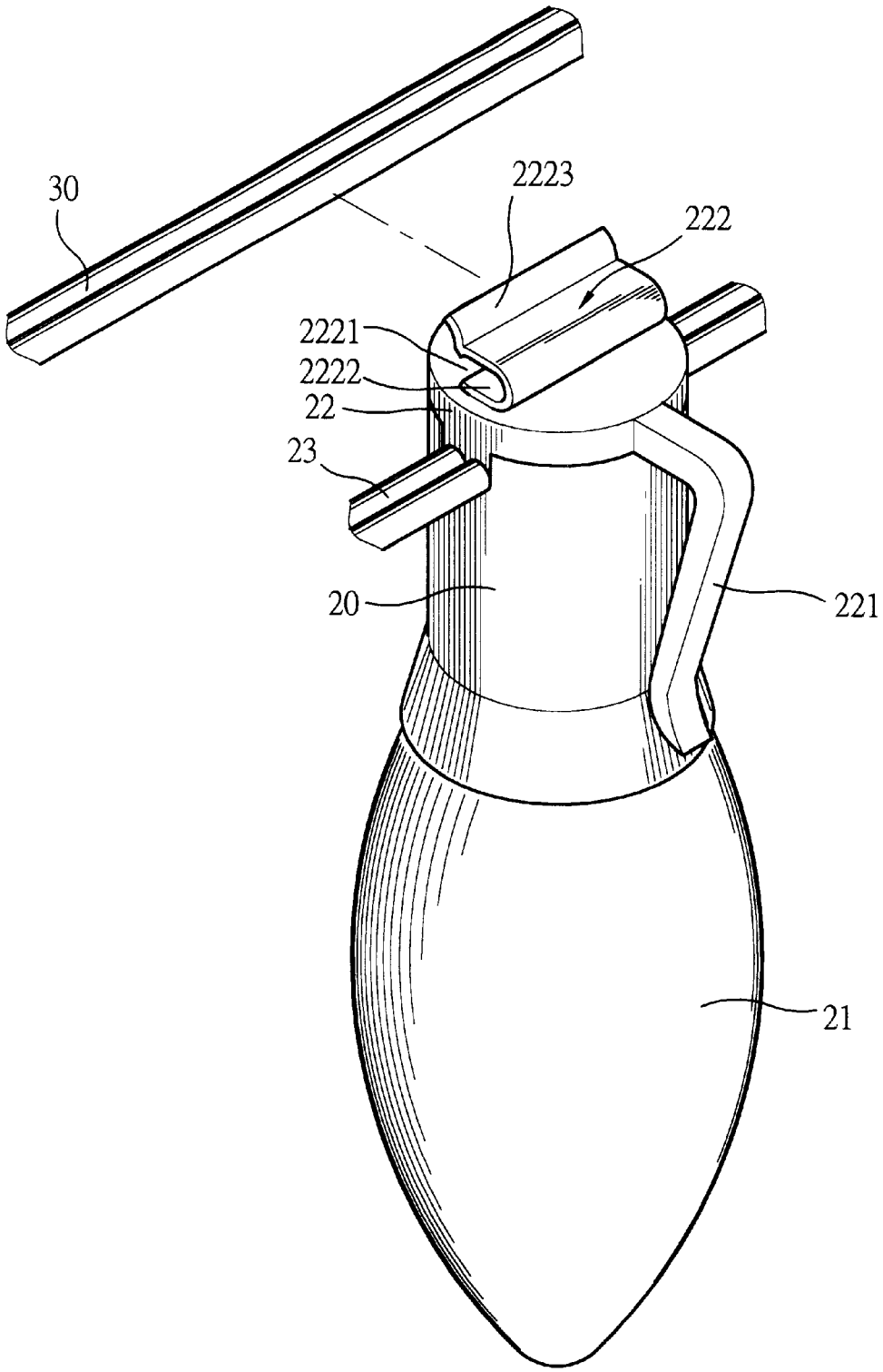
FIG. 2 is an exploded perspective view of a Christmas light according to the preferred embodiment of the present invention.
Figure 3:
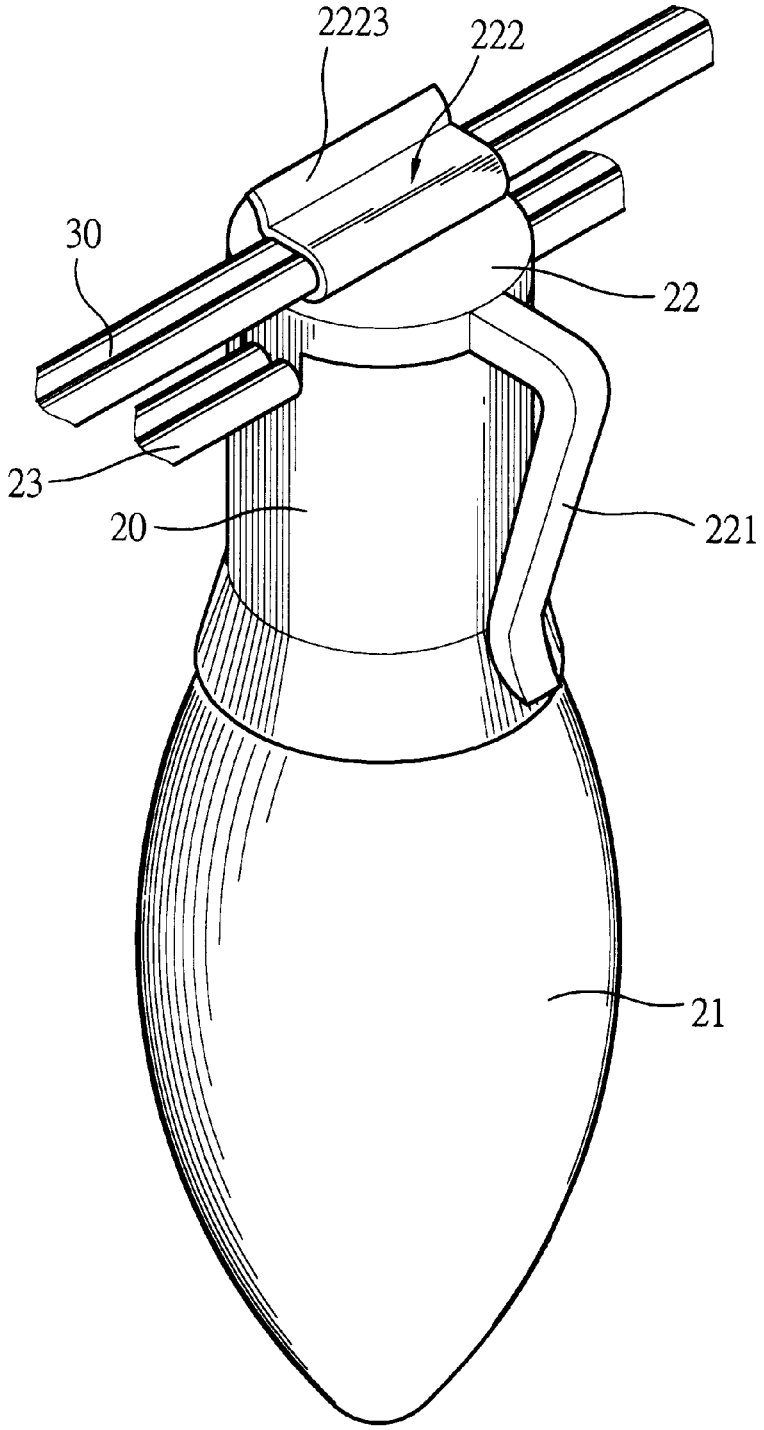
FIG. 3 is a perspective view of FIG. 2 indicating that the elastic attachment of the present invention is attached to a pair of additional electric wires.

With reference to FIG. 2 of the drawings. The Christmas of the present invention comprises generally an electrical socket 20, a bulb 21 engaged into the socket 20 and a cap 22 secured to the bottom of the socket 20 with pair of electrical wires 23 engaged therebetween.

The cap 22 includes a hook 221 elastically stopped against an outer periphery of the socket 20 and an elastic attachment 222 on an outer surface of the cap 222. The elastic attachment 222 is an arcuate plate of roughly U-shaped section which is made from elastic material. The arcuate plate includes a lower end integrated with a central outer surface of the cap 222, an upwardly projected upper end 2223 which is provided to facilitate finger operation of the elastic attachment 222 and a ready accession of a linear object 30 into the elastic attachment, a narrow entrance 2221 formed under the upper end 2223 and an arcuate receiving space 2222 which is able to grip the linear object 30 such as a pair of electrical wires or any linear object accessible into the entrance 2221.

Figure 4:
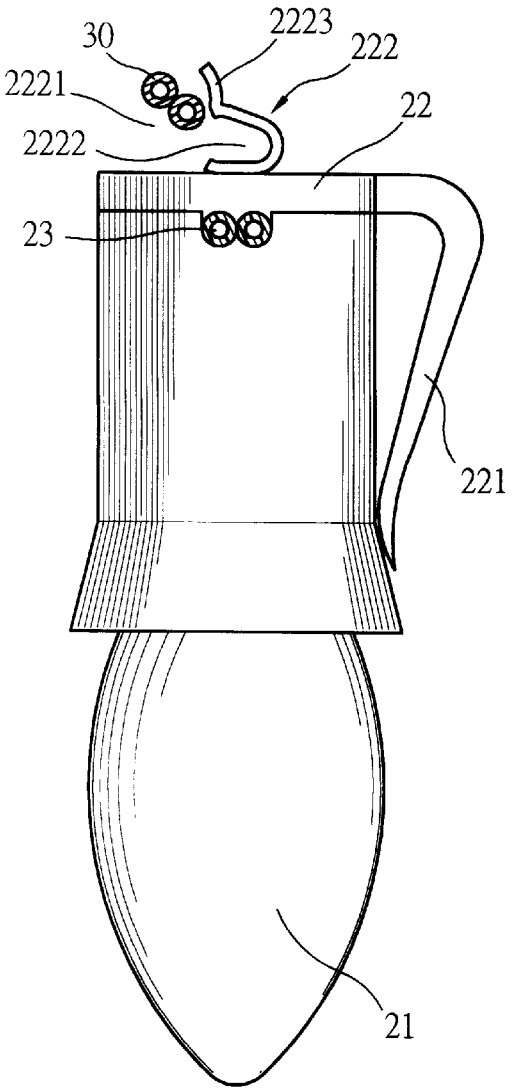
FIGS. 4 and 5 are the perspective view and partially sectional view indicating the operation of the elastic attachment.
Figure 5:
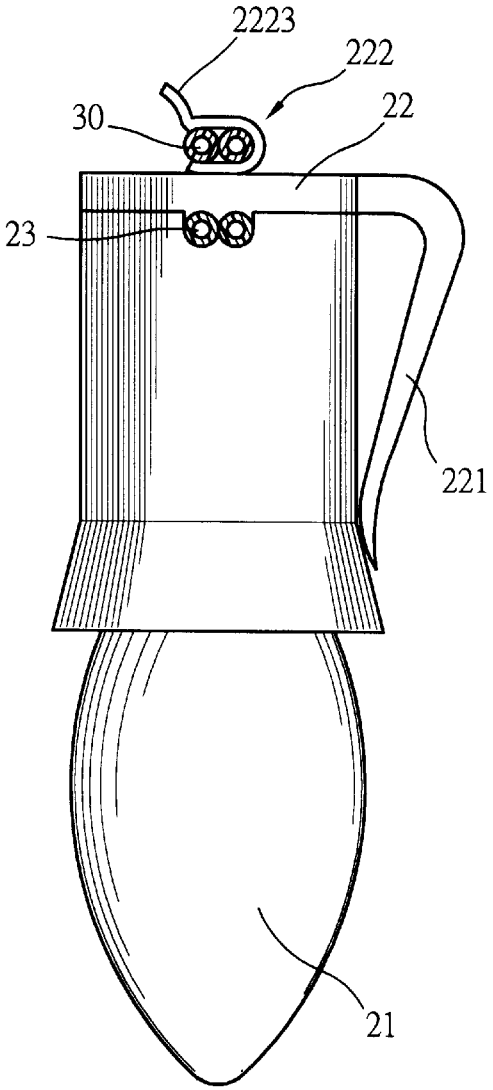

Based on the above discussed embodiment, the operation of the elastic attachment of the present invention is indicated in FIGS. 4 and 5. When attaches the Christmas light to the linear object 30 (as shown in FIG. 4.) first bend the upper end 2223 of the attachment 222 upward so as to broaden the narrow entrance 2221 in order to facilitate the linear object 30 to readily enter into the arcuate receiving space 2222 and then release the upper end 2223 as the object 30 is already in place into the receiving space 2222 (as shown in FIG. 5).

Accordingly, the elastic attachment 222 of the Christmas light of the present invention has the following advantages:

1. slightly bending the upper end 2223 of the elastic attachment 222 upward can readily attach the Christmas light to a linear object 30 without pulling the linear object,
2. it reliably clips the linear object 30 without breakaway,
3. slightly bending the upper end 2223 can readily release the attachment 222 from the linear object 30, causing no any damagement, and
4. the tightly gripping the linear object 30 by the elastic attachment 222 can keep the Christmas lights toward a predetermined direction.

The specification relating to the above embodiment should be construed as exemplary rather than as imitative of the present invention, with many variations and modifications being readily attainable by a person of average skill in the art without departing from the spirit or scope thereof as defined by the appended claims and their legal equivalents.

I claim:

1. A Christmas light with an elastic attachment comprising:

an electrical socket having an opening engaged with a bulb therein and bottom;

a circular cap secured to the bottom of the socket and gripping a pair of electrical wires therebetween;

said circular cap including a hook having a free end stopped against an outer periphery of the socket and an outer surface;

an elastic attaching means integrated with the outer surface of said circular cap, said attaching means including an arcuate elastic plate of U-shaped section to define an arcuate receiving space therein, a lower end radically integrated with a center of the outer surface of said circular cap, an upwardly projected upper end and an entrance narrower than said arcuate receiving positioned under said upper end and abutting said arcuate receiving space;

whereby said elastic attaching means can readily grip a linear object without breakaway.

* * * * *